US012194367B2

(12) United States Patent
Oliver

(10) Patent No.: US 12,194,367 B2
(45) Date of Patent: Jan. 14, 2025

(54) UNCOUPLED ANTERIOR CRANIAL SHIELD

(71) Applicant: VAULT PROTECTIVE INNOVATIONS, INC., Roanoke, VA (US)

(72) Inventor: Eric R. Oliver, Roanoke, VA (US)

(73) Assignee: VAULT PROTECTIVE INNOVATIONS, INC., Roanoke, VA (US)

( * ) Notice: Subject to any disclaimer, the term of this patent is extended or adjusted under 35 U.S.C. 154(b) by 0 days.

(21) Appl. No.: 17/382,670

(22) Filed: Jul. 22, 2021

(65) Prior Publication Data

US 2022/0023741 A1 Jan. 27, 2022

Related U.S. Application Data

(60) Provisional application No. 63/055,093, filed on Jul. 22, 2020.

(51) Int. Cl.

| | |
|---|---|
| ***A63B 71/10*** | (2006.01) |
| ***A63B 71/12*** | (2006.01) |
| *A41D 13/05* | (2006.01) |
| *A42B 3/08* | (2006.01) |
| *A42B 3/12* | (2006.01) |
| *A42B 3/14* | (2006.01) |
| *A42B 3/18* | (2006.01) |

(Continued)

(52) U.S. Cl.

CPC ..... *A63B 71/10* (2013.01); *A63B 71/1291* (2013.01); *A41D 13/0512* (2013.01); *A41D 13/0518* (2013.01); *A42B 3/08* (2013.01); *A42B 3/121* (2013.01); *A42B 3/14* (2013.01); *A42B 3/18* (2013.01); *A42B 3/20* (2013.01); *A63B 71/08* (2013.01); *A63B 2071/105* (2013.01); *A63B 2243/007* (2013.01)

(58) Field of Classification Search

CPC .. A42B 3/18; A42B 3/20; A42B 3/121; A42B 3/08; A42B 3/14; A42B 3/142; A42B 3/147; A63B 2071/105; A63B 2071/1208; A63B 71/08; A63B 71/10; A41D 13/0518; A41D 13/0512

See application file for complete search history.

(56) References Cited

U.S. PATENT DOCUMENTS

| | | | | |
|---|---|---|---|---|
| 2,756,429 A * | 7/1956 | Malachowski | ..... | A63B 71/12 2/463 |
| 3,302,214 A * | 2/1967 | Yuritch | ..... | A63B 71/08 273/455 |
| 4,825,476 A | 5/1989 | Andrews | | |

(Continued)

FOREIGN PATENT DOCUMENTS

WO 2016164653 A1 10/2016

*Primary Examiner* — Megan E Lynch
*Assistant Examiner* — Giao Q T Hoang
(74) *Attorney, Agent, or Firm* — McNees Wallace & Nurick LLC

(57) ABSTRACT

An uncoupled anterior cranial shield is disclosed including a yoke configured to attach to support garment or integrated with the support garment and a suspended mask attached to the yoke and extending from the yoke so as to be disposed at least partially covering a face of an individual wearing the support garment. The suspended mask is free of force communicating persistent connection to a head of the wearer other than indirectly through the shoulder pads.

22 Claims, 12 Drawing Sheets

(51) Int. Cl.
*A42B 3/20* (2006.01)
*A63B 71/08* (2006.01)

(56) References Cited

U.S. PATENT DOCUMENTS

| | | | | |
|---|---|---|---|---|
| 4,999,855 | A | 3/1991 | Brown | |
| 5,353,437 | A | 10/1994 | Field et al. | |
| 5,483,698 | A * | 1/1996 | Douglas, Jr. | A41D 13/0512 2/468 |
| 5,546,609 | A | 8/1996 | Rush, III | |
| 5,581,816 | A | 12/1996 | Davis | |
| 6,006,368 | A | 12/1999 | Phillips | |
| 6,378,140 | B1 | 4/2002 | Abraham et al. | |
| 6,385,781 | B1 | 5/2002 | Rose et al. | |
| 6,874,170 | B1 | 4/2005 | Aaron | |
| 7,062,795 | B2 | 6/2006 | Skiba et al. | |
| 9,238,167 | B2 | 1/2016 | Monica | |
| 9,439,462 | B2 * | 9/2016 | Czajka | A62B 18/084 |
| 9,603,405 | B2 | 3/2017 | Blecherman et al. | |
| 10,016,006 | B2 | 7/2018 | Popejoy | |
| 2005/0166303 | A1 | 8/2005 | Aaron | |
| 2006/0096010 | A1 * | 5/2006 | Glaser | A42B 3/0473 2/421 |
| 2010/0088808 | A1 | 4/2010 | Rietdyk et al. | |
| 2011/0277225 | A1 | 11/2011 | Salkind et al. | |
| 2013/0031706 | A1 | 2/2013 | Cooksey | |
| 2013/0205480 | A1 | 8/2013 | Nagely | |
| 2014/0020161 | A1 * | 1/2014 | Mason | A63B 71/12 2/463 |
| 2014/0109305 | A1 | 4/2014 | Kerr | |
| 2014/0237707 | A1 | 8/2014 | Lane | |
| 2015/0113718 | A1 | 4/2015 | Bayer | |
| 2017/0035137 | A1 | 2/2017 | Blecherman et al. | |
| 2017/0065016 | A1 | 3/2017 | Chuback et al. | |
| 2017/0251742 | A1 | 9/2017 | Partlo | |
| 2017/0259154 | A1 * | 9/2017 | Glasser | A63B 69/02 |
| 2017/0290386 | A1 * | 10/2017 | Murray | A41D 13/0512 |
| 2017/0367427 | A1 | 12/2017 | Meade | |
| 2018/0193717 | A1 * | 7/2018 | Trigo | A63B 71/12 |
| 2019/0082769 | A1 * | 3/2019 | Barr | A42B 3/0473 |
| 2019/0201775 | A1 | 7/2019 | Requa | |
| 2020/0154812 | A1 * | 5/2020 | Popejoy | A42B 3/20 |

* cited by examiner

UNCOUPLED ANTERIOR CRANIAL SHIELD

RELATED APPLICATIONS

This application claims the benefit of and priority to U.S. Provisional Patent Application No. 63/055,093, filed Jul. 22, 2020, entitled "Uncoupled Anterior Cranial Shield," which is hereby incorporated by reference in its entirety.

FIELD OF THE INVENTION

The present application describes an uncoupled anterior cranial shield. More particularly, the present application describes an anterior cranial shield which is uncoupled from a helmet for use in collision sports and/or other physical endeavors.

BACKGROUND OF THE INVENTION

In recent years, scrutiny of American football player safety has intensified due to further elucidation that head impact exposures may increase risk of delayed neurologic and psychiatric dysfunction (NPD), including the neurodegenerative disease chronic traumatic encephalopathy (CTE). In CTE, the Tau protein has been shown to form clumps that proliferate through the brain, resulting in cellular death. The symptoms do not generally begin appearing until years after the onset of head impacts. Early symptoms have been seen in younger patients (17 years to 30 years) with the onset of cognitive changes in later years. NPD and CTE symptoms include cognitive decline, impaired judgment, diminished impulse control, aggression, depression, anxiety, degraded motor function, and progressive dementia. No consensus has formed to define the aggregate football risk factors for chronic NPD and CTE due to study limitations and disparate findings. However, it is universally accepted that advances in brain protection are essential for both short- and long-term player safety. The consolidation of compelling, coalescent high-quality scientific evidence that cumulative sub-concussive (repetitive subthreshold accelerations to the brain) football head impacts contribute to delayed NPD and CTE will further challenge the existence of the most popular American sport in its present form.

A concussion is a form of traumatic brain injury (TBI) that results when mechanical force transmission to the brain causes overt acute symptoms. These symptoms may include temporary loss of consciousness, memory loss, difficulty concentrating, confusion, visual disturbances, nausea, headache, dizziness, and light sensitivity. Such symptoms may present either immediately or hours to days after the initiating impact(s). Other potential delayed symptoms include mood changes, sleep disturbance, depression, and anxiety. Symptoms typically resolve within days to weeks but may rarely persist for months or longer. The sudden accelerative/decelerative forces transmitted by an external impact are thought to structurally strain the brain as it "jostles" within the skull. Such forces are transferred to the brain resulting in damage to the neuronal tissue. Stretching of the neurons occur in response to these forces as the brain and surrounding cerebrospinal fluid bath move in a delayed fashion to the motion of the head. The brain is tethered to the spinal cord and rapid motion of the brain will result in axonal injuries. Stretching of the neuronal axons will disrupt their overall physiologic functioning and culminate in concussion symptoms. A sub-concussive event occurs when the transmitted mechanical energy injures neurons by a similar mechanism, but the impact intensity does not exceed the severity threshold to instigate the cellular damage that causes overt symptoms (a sub-concussive sub-clinical injury).

While acute concussions inherently receive the most attention from the general public, the insidious, cumulative, sub-concussive repetitive head impacts (RHI) may pose an equal or greater risk in the development of delayed NPD/CTE. Repetitive sub-concussive hits may also introduce an independent mechanism for a concussion. Repetitive sub-threshold impacts (accelerative/decelerative stimuli) to the brain are analogous to the fatigue principle of human tissue. Repetitive cyclical loading of a tissue will result in a lesser force (lower thresholds or tolerances of the tissue with repeated cycles) needed to induce injury. Depending on the level of competition and position played, helmet accelerometer studies have demonstrated that football players may sustain 500 to 2,000 low-impact sub-concussive hits to the head during a typical football season. A repetitive stimulus of 500 to 2,000 low-impact hits to the football player's head can lead to fatigue of the brain tissue and further exposure to repetitive subthreshold loads. Investigators have diagnosed CTE in brains that have a history of RHI but lack a known history of concussion.

Some researchers assert that an earlier age of first exposure to full contact football increases the risk of developing NPD/CTE and advocate delaying tackle football due to unknown implications of RHI upon the developing brain. Youth football participation has significantly declined in recent years, due in large part to parental safety concerns. A recent advocacy advertisement from the Concussion Legacy Foundation juxtaposed youth tackle football with smoking tobacco. Canada has banned full-team youth football, starting in 2022. Members of five (5) state legislatures have introduced bills to ban tackle football for young players, and public sentiment/initiatives to translate such efforts into law will gain momentum with accumulation of corroborating evidence that early football participation is associated with NPD/CTE. Pediatric head and brain injuries related to sports is now firmly within the public health domain.

Football, similar to other collision sports such as hockey and lacrosse, offer tremendous opportunities for youth to develop discipline, teamwork, sportsmanship, and work ethic, while promoting physical exercise, activity, and conditioning in the modern world of ubiquitous sedentary activity opportunities. Many would agree that football and other collision team sports are worth preserving for the positive qualities they may instill in players for a lifetime.

Innovation with respect to protective equipment for the head and brain in football has focused on enhancement of the materials and properties of the contemporary helmet. The basic design of the modern football helmet consists of a hard polycarbonate plastic external shell, internal padding and cushioning, and an externally attached metal facemask. Other than incremental improvements in materials utilization, external shell strength/deformation properties, padding integrations, and overall aesthetics, this basic design has remained essentially unchanged for a half-century. However, during this same period of time, players have become bigger, faster, and stronger, which translates to a concomitant increase in potential supraphysiological forces, and more importantly, repetitive subthreshold (sub-concussive) dynamic force exposure on the field of play.

Football head protection has not kept pace with the bigger, faster, stronger athlete. Contemporary plastic shell football helmets have certainly markedly reduced skull fractures compared to their pre-1950 leather predecessors, but they have offered limited benefits for concussion prevention. One study actually concluded that antiquated leather soft helmets provide the same concussive injury protection as modern helmets. Such a conclusion likely confirms that protective equipment applied exclusively to the head simply is incapable of sufficiently attenuating the complex mechanical force transmission responsible for concussions. Furthermore, the hard-shell helmets with foam linings do not provide ample dampening of the forces and may transfer greater forces to the brain tissue.

The following corollary from that conclusion most likely also applies: protective equipment applied exclusively to the head is incapable of sufficiently attenuating and reducing the myriad of sub-concussive head impacts sustained in football and other collision sports. Most football head impacts are a combination of complex linear and rotational accelerative mechanical forces, which may cause an intense transient torsional strain on the brain and worsen with secondary rebound from the more compliant helmet components (i.e. foam lining that compresses upon impact and rebounds). As stated previously, concussive events are likely only one of several factors posing risks to long-term brain health in certain players, and the accumulation of sub-concussive hits/RHI may present an equal or greater risk. Repetitive sub-concussive hits to the player's head and/or body resulting in a subthreshold acceleration/deceleration force event to the skull and brain, is analogous to tissue fatigue. Tissue fatigue is due to long term repetitive cyclic loading at subthreshold forces that if applied one to two times to tissue may not induce short or long-term injury. However, if the subthreshold force is repetitively transferred to the tissue, the tissue will eventually suffer injury. In essence, where a single cycle of peak acceleration at threshold levels to tissue can cause injury after a single hit (i.e. concussions can occur at thresholds exceeding at least 65 g to 70 g forces in adult athlete measurements) (Broglio), repetitive forces to the skull and brain can occur after a series of repetitive forces at sub-concussive or subthreshold levels. It is well documented that fatigue of human tissue occur at significantly lower values than the static ultimate strength of the tissue. Fatigue failures in human tissue have been shown to occur at approximately 50-60% of the static ultimate failures through cadaveric testing. In essence, it will take less force to induce injury to the brain and neural tissue with repetitive loading (hits) to the head. There is an exponential correlation between force magnitude and repetitive cycles.

While helmets ostensibly reduce impact intensity or the overall force transmission ultimately absorbed by the brain soft tissue itself, no current head protective system offers a practical means to reduce RHI frequency. Therefore, not only is added protection needed to supplement the helmet protection, but there is a vital need for a new option and/or solution for a sport that faces justifiable intensive scrutiny from a manifold cast of groups to include safety advocates, politicians, researchers, parents, and the players themselves.

Football concussions have relatively decreased over the last several years (although there was an increase within the NFL during the 2019 season), most likely due to a combination of modifications in practice methods/culture, coaching, officiating emphasis, tackling technique, and rules. However, despite such efforts and helmet technology improvements, the potential for a concussion persists due to the inability to eliminate the complex accelerative and rotational forces inherent in the high frequency collision sport that is American football. Principal among the significant rules modifications implemented over the last decade is the penalty "targeting," which, at the collegiate level, results in disqualification of a player initiating and engaging in helmet-to-helmet contact. Despite best efforts by players, the high-speed dynamic nature and action of the game does not permit complete elimination of such helmet-to-helmet contacts, and unintentional/unavoidable head-to-head collisions are inevitable.

There is a vital need for a new option and/or solution for a sport that faces justifiable intensive scrutiny from a manifold cast of groups to include safety advocates, politicians, researchers, parents, and the players themselves. Players would benefit from a more comprehensive head protective system that decreases the probability and frequency of unintentional (and intentional) direct helmet-to-helmet contacts. A profound advance in head and brain protection combined with effective exposure safety guidelines derived from high-quality research may provide a path to preserving football and other collision sports for younger players.

BRIEF DESCRIPTION OF THE INVENTION

In an exemplary embodiment, an uncoupled anterior cranial shield includes a yoke configured to attach to support garment, such as, but not limited to, athletic shoulder pads, or is integrated with the support garment, and a suspended mask attached to the yoke and extending from the yoke so as to be disposed at least partially covering a head and face of an individual wearing the support garment, providing a 'downstream' protective zone for the head from oncoming anteriorly directed forces, which form the vast majority of forces in most collision sports. The suspended mask is free of force communicating persistent connection to a head of the wearer other than indirectly through the support garment.

In use, the uncoupled anterior cranial shield is configured to redirect impact force from a player collision away from the wearer's head and neck and into the wearer's torso, including, but not limited to, into the wearer's chest, trapezius muscles, and/or upper back. The uncoupled anterior cranial shield configuration may be customized and/or optimized to accommodate various football player positions. By way of example, the configuration may be different for a player playing primarily from a 3-point stance compared to a 2-point stance. This additional head protection may be particularly advantageous to lineman who experience the highest repetitive head impact burden throughout practices and games, or perhaps defensive players such as linebackers to protect the frontal and crown regions of the head during higher frequency, high velocity tackling conditions. The football playing position consists of knees flexed with a simultaneous neck extension and torso flexion condition, referred to in this application as the athletic playing position. In one embodiment, the suspended mask is positioned such that it sufficiently protects the head in the athletic playing position, while also minimizing player overall exposed area during play. In another embodiment, in the standing neutral position, a posture that is only utilized during competition by the quarterback and perhaps defensive safety, the suspended mask is positioned closer to the helmet, offering relative decreased range of motion for neck flexion condition (a standing player looking down at the ground) in order to optimize protection in the athletic playing position.

BRIEF DESCRIPTION OF THE DRAWINGS

Features and advantages of the general inventive concepts will become apparent from the following description made with reference to the accompanying drawings, including drawings represented herein in the attached set of figures, of which the following is a brief description:

FIG. 26 (*b*) is a side elevation view of an uncoupled anterior cranial shield showing the result of an application of force, according to an embodiment of the present invention.

FIG. 27 (*b*) is a side elevation view of an uncoupled anterior cranial shield showing the result of an application of force, according to an embodiment of the present invention.

FIG. 28 (*b*) is a side elevation view of an uncoupled anterior cranial shield on an augmented chest guard showing the result of an application of force, according to an embodiment of the present invention.

Figure 1:
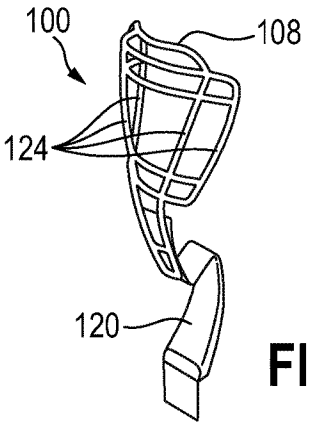
FIG. 1 is a front-side perspective view of a suspended mask of an uncoupled anterior cranial shield, according to an embodiment of the present invention.

This disclosure describes exemplary embodiments in accordance with the general inventive concepts and is not intended to limit the scope of the invention in any way. Indeed, the invention as described in the specification is broader than and unlimited by the exemplary embodiments set forth herein, and the terms used herein have their full ordinary meaning.

Wherever possible, the same reference numbers will be used throughout the drawings to represent the same parts.

KEY TO REFERENCE NUMERALS USED IN THE DRAWINGS

10—Standard Facemask
100—Uncoupled Anterior Cranial Shield
102—Yoke
104—Support Garment
106—Athletic Shoulder Pads
108—Suspended Mask
110—Connection Point
112—Main Body Arch
114—Neck Aperture
116—Anterior Opening
118—Posterior Opening
120—Impact Collar Extension
122—Fixation Point
124—Interconnected Bars
126—Transparent Visor Extension
128—Guard
130—Hinge
132—Augmented Chest Guard

DETAILED DESCRIPTION

An uncoupled anterior cranial shield is provided for use in athletic or physical endeavors requiring head protection, particularly where concussive and sub-concussive repetitive head impacts are a concern. The system described within this application offers a novel approach and an overall paradigm shift for head protection in football and other sports. This system may better protect the brain from the sub-clinical yet deleterious lower impact sub-concussive hits and reduce the severity and intensity of certain higher impact collisions of the head region, while also conferring increased protection to the neck and spine. For example, in the context of American football, this system uncouples the standard facemask from the helmet by integrating the facemask as a primary protective component emanating from the shoulder pads, thus creating a combined dual face and head protector that is independent of the helmet itself. The facemask is now coupled with the shoulder pads, conferring protection to both the face and head independent of an exclusive connection to the head. Thus, this component is not a "facemask" alone, but rather now a combined face and head protector, designated the uncoupled anterior cranial shield. The goal of the uncoupled anterior cranial shield is to provide supplemental protection from brain injuries to the helmeted head by adding additional energy dissipation away from the head and spine.

Figure 2:
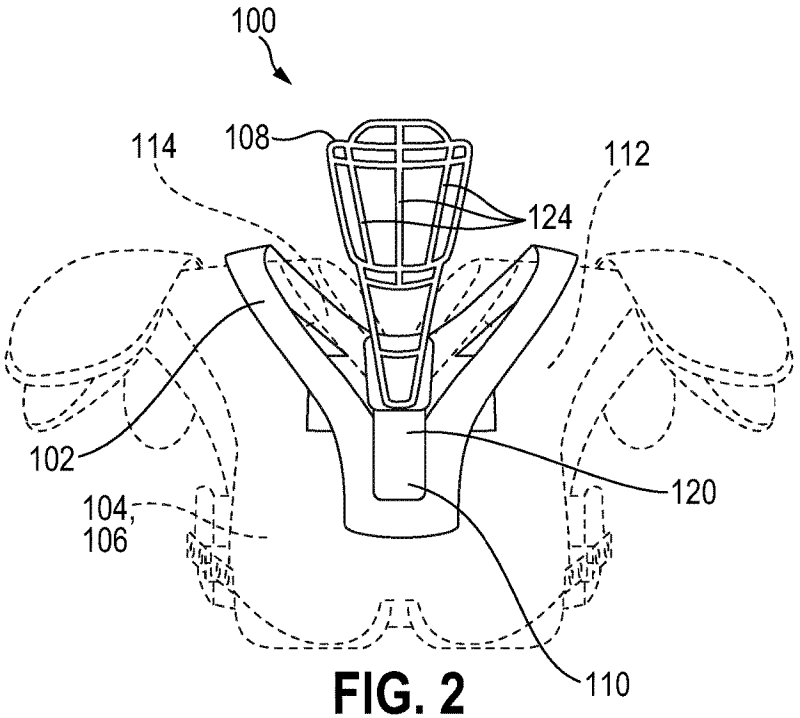
FIG. 2 is a front elevation view of an uncoupled anterior cranial shield, according to an embodiment of the present invention.
Figure 3:
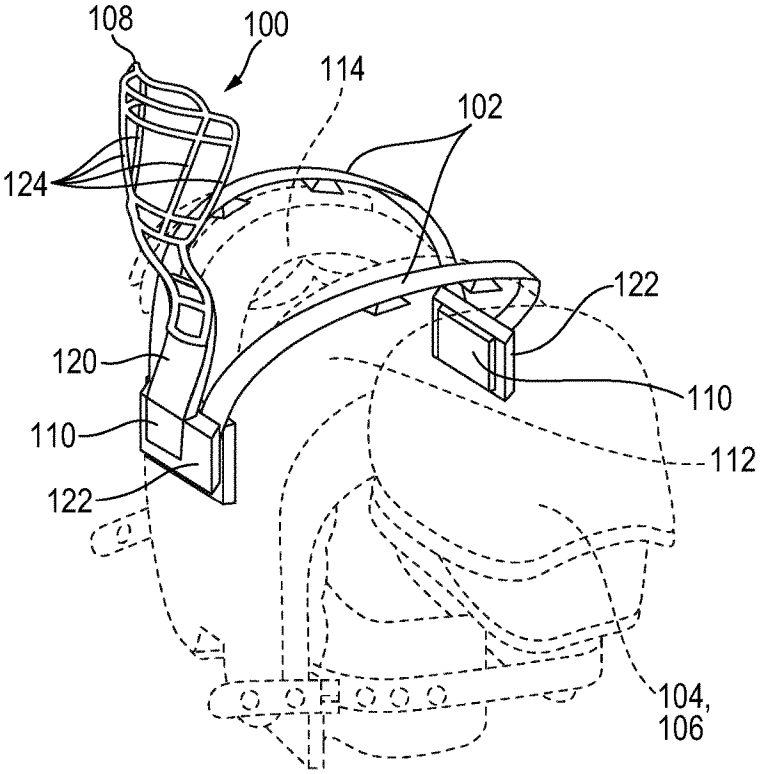
FIG. 3 is a front-side perspective view of the uncoupled anterior cranial shield of FIG. 2, according to an embodiment of the present invention.
Figure 4:
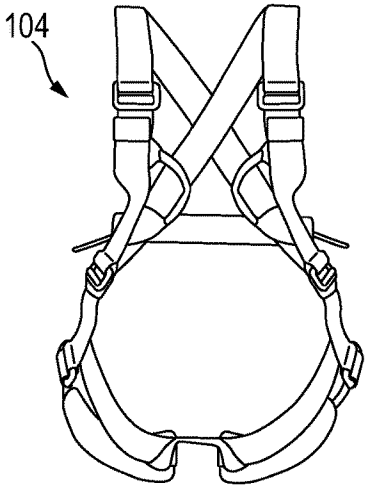
FIG. 4 is a top plan view of an exemplary support garment an uncoupled anterior cranial shield, according to an embodiment of the present invention.
Figure 5:
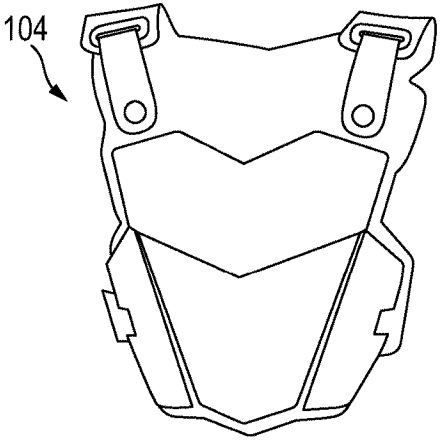
FIG. 5 is a front-side perspective view of an exemplary support garment an uncoupled anterior cranial shield, according to an embodiment of the present invention.
Figure 6:
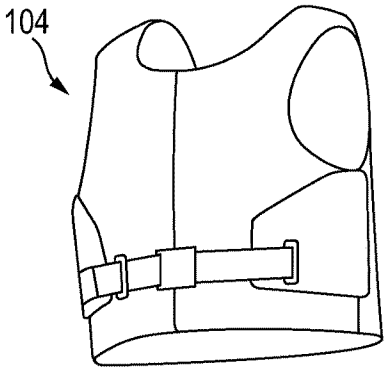
FIG. 6 is a front-side perspective view of an exemplary support garment an uncoupled anterior cranial shield, according to an embodiment of the present invention.
Figure 7:
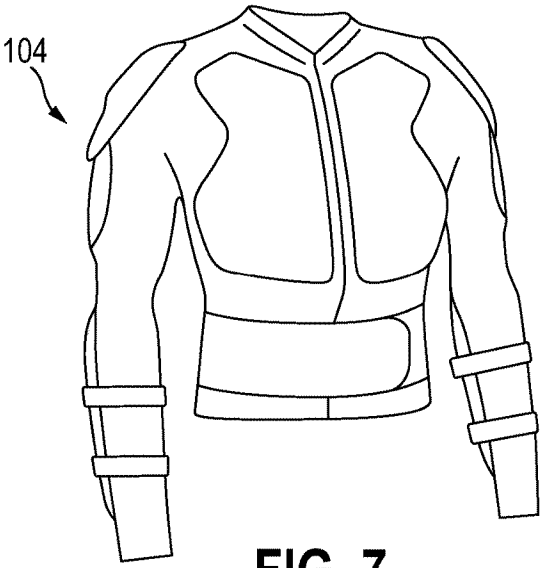
FIG. 7 is a front-side perspective view of an exemplary support garment an uncoupled anterior cranial shield, according to an embodiment of the present invention.
Figure 8:
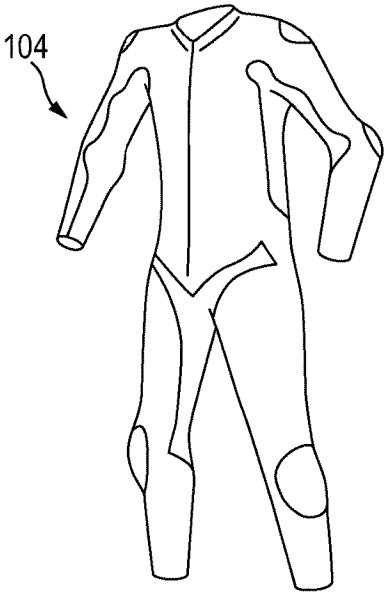
FIG. 8 is a front-side perspective view of an exemplary support garment an uncoupled anterior cranial shield, according to an embodiment of the present invention.
Figure 9:
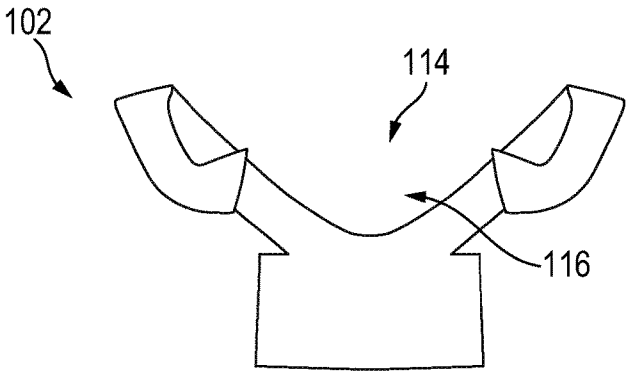
FIG. 9 is a front elevation view of a yoke, according to an embodiment of the present invention.
Figure 10:
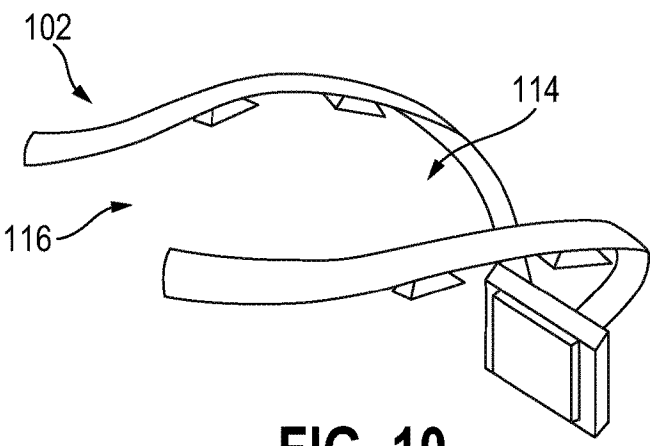
FIG. 10 is a front-side perspective view of the yoke of FIG. 9, according to an embodiment of the present invention.
Figure 11:
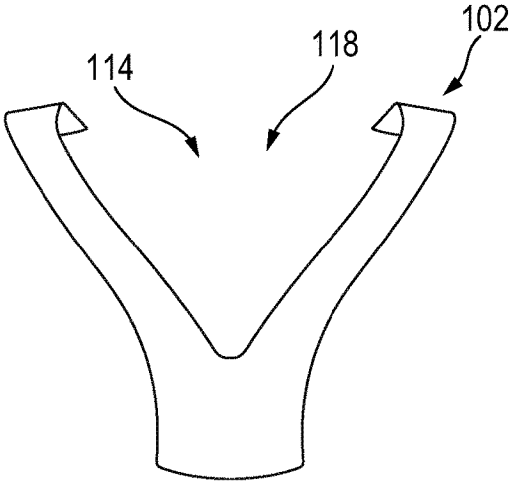
FIG. 11 is a front elevation view of a yoke, according to an embodiment of the present invention.
Figure 12:
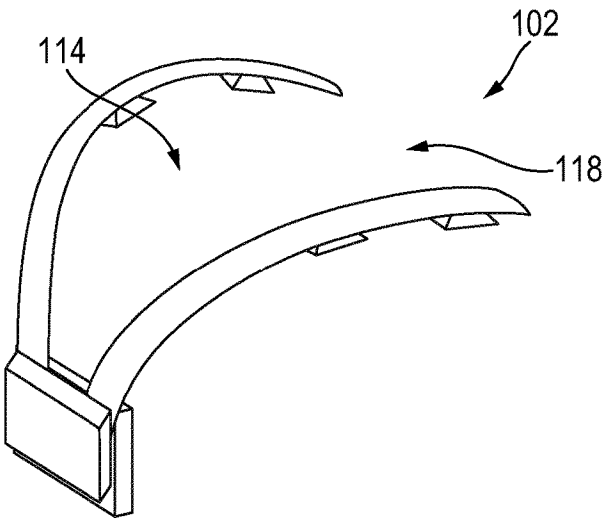
FIG. 12 is a front-side perspective view of the yoke of FIG. 11, according to an embodiment of the present invention.

Referring now to the drawings, as shown in FIGS. 1-3, an uncoupled anterior cranial shield 100, includes a yoke 102 configured to attach to support garment 104 (shown in an embodiment that is in the form of athletic shoulder pads 106) or integrated with the support garment 104 and a suspended mask 108 attached to the yoke 102 and extending from the yoke 102 so as to be disposed at least partially covering a face of an individual wearing the support garment 104. In the depicted embodiments, the support garment 104 is represented as athletic shoulder pads 106.

It will be appreciated by one of ordinary skill in the art that the support garment 104 that is suitable for a sport may vary, and thus as represented in FIGS. 4-8, the support garment 104 may be in the form of a harness (FIG. 4) formed of one or more interconnected straps, such as for climbing, construction and other activities, or a chest protector (FIG. 5), such as for hockey and other ice sports, or a fitted vest (FIG. 6), such as for equestrian sports, or of a form fitting shirt (FIG. 7) or a partial or whole body suit (FIG. 8), such as for motor sports or skiing, or in the form of athletic shoulder pads 106, as shown variously in the drawings, or another garment or fitted wearable article that is suitable for donning by a user to securely attach an assembly that includes the yoke 102 and suspended mask 108.

Referring again to FIGS. 1-3, the suspended mask 108 is free of force communicating persistent connection to a head of the wearer other than indirectly through the support garment 104. As used herein, "force communicating persistent connection" indicates that connection that is persistent and which is capable of communicating force in its persistent state. By way of example for illustrative purposes, a slack line or chain would not be considered force communicating in its persistent state, even if the slack line or chain were capable of being tensioned as a result of intermittent stimuli; however, a tensioned line or chain would be considered force communicating in its persistent state, even if the tensioned line or chain were capable of becoming slack as a result of intermittent stimuli-but return to its tensioned state after stimuli to maintain a communicating connection.

In embodiments in which the yoke 102 is configured to attach to the support garment 104, the attachment may be secured with any suitable connection technique or fasteners, some examples of which are described herein below. The attachment locations and connection techniques or fasteners are selected so as to ensure that the wearer's neck is protected from a structural failure or translation of the yoke 102 into the neck. Force dissipated materials or devices such as shock absorbers may be integrated anywhere within the yoke 102, with or without force dissipating connection washers composed of materials such as, but not limited to, synthetic viscoelastic urethane polymers (such as SORBOTHANE, manufactured by Sorbothane, Inc. in Kent, Ohio), and other suitable structures and materials as further described herein below.

The connection point 110 between the yoke 102 and the support garment 104 may be optimized for force distribution based on one or more factors including the weight, height and build of the wearer, and the likely impacts that the wearer may experience in view of the activity in which they engage (e.g., American football) and in some instances the wearer's role or position in the sport (e.g., American football offensive lineman). With regard to the wearer's physical attributes, i.e., on the individual level, the one or more connection point 110 between the yoke 102 and the support garment 104 may be optimized relative to the physiology and body shape of the wearer. With regard to the wearer's activity and role, i.e., on the position level, the one or more connection point 110 between the yoke 102 and the support garment 104 may be optimized based on the expected impacts and flexibility of the role or position played by the wearer. By way of example, with reference again by way of example only to wearers who play American football, offensive linemen may have a need for increased neck extension due to consistently playing from a three-point stance and may benefit from a different configuration compared to a cornerback or wide receiver.

It will be appreciated that the drawings demonstrate a connection point 110 that is depicted as a rectilinear shaped feature. It will be appreciated, of course, that a yoke 102 may be affixed to the support garment 104 as an integral part thereof rather than affixed to the support garment 104, and that in any instance, the area and/or shape of the connection point 110 on the support garment 104 may vary. Thus, while in the depicted embodiment of the support garment 104 that comprises an athletic shoulder pads 106, the connection point 110 as assembled with the yoke 102 may be provided as an separate assembly for attachment to any of a wide variety of known athletic shoulder pads 106, in other embodiments, the at least the connection point 110 may be integral with the support garment 104 and adapted for engagement with a yoke 102, or the entire assembly of the connection point 110 as assembled with the yoke 102 may be provided as integral with the support garment 104.

In one embodiment, the yoke 102 serves as a structural foundational arch support for the suspended mask 108, a primary force distributor for the uncoupled anterior cranial shield 100, and a primary connectivity interface between the shoulder pads 106 and the suspended mask 108. The key mechanical operation of the yoke 102 is elastic deformation away from its one or more connection point 110 with the support garment 104 in a general cantilever type motion of the suspended mask 108 to dissipate force and thereby diminish the transmission of force to the body of the wearer.

The yoke 102 may be composed of any suitable material, including, but not limited to, polycarbonates, carbon fiber reinforced polymers, carbon fiber alloys, titanium, aramids, poly-paraphenylene terephthalamide, auxetic materials, rubber composites, or combinations thereof.

The yoke 102 may be configured to attach to or be integrated with a main body arch 112 of the support garment 104. The yoke 102 may configured to be elevated from the main body arch 112 when attached to or integrated with the shoulder pads 106 over at least 50% of a surface area of the yoke 102, alternatively at least 55%, alternatively at least 60%, alternatively at least 65%, alternatively at least 70%, alternatively at least 75%, alternatively at least 80%, alternatively at least 85%, alternatively at least 90%, and to attach to or be integrated with the main body arch 112 in discrete locations. The yoke 102 may be configured to be integrated with or attached to the main body arch 112 at one of, two of, or all three of a chest portion of the shoulder pads 106, a trapezius muscle portion of the shoulder pads 106, and an upper back portion of the shoulder pads 106.

Figure 14:
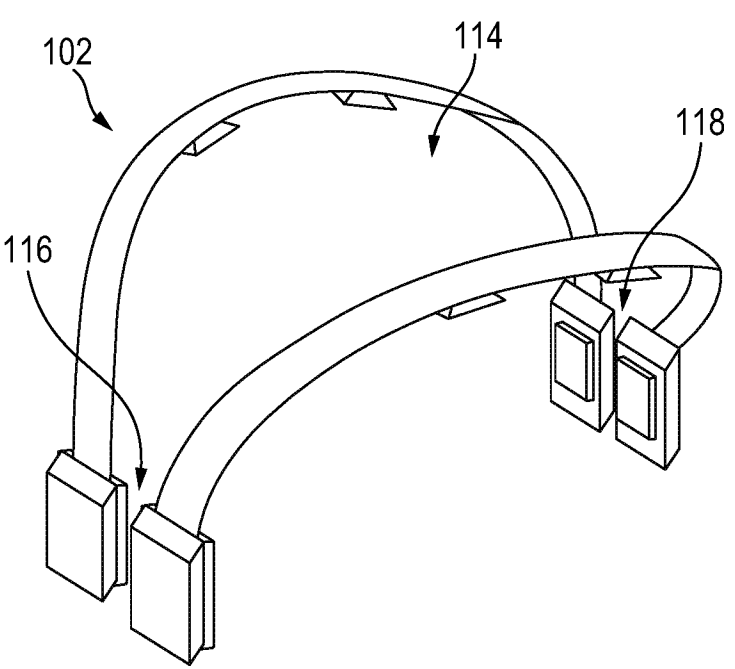
FIG. 14 is a front-side perspective view of a yoke, according to an embodiment of the present invention.
Figure 13:
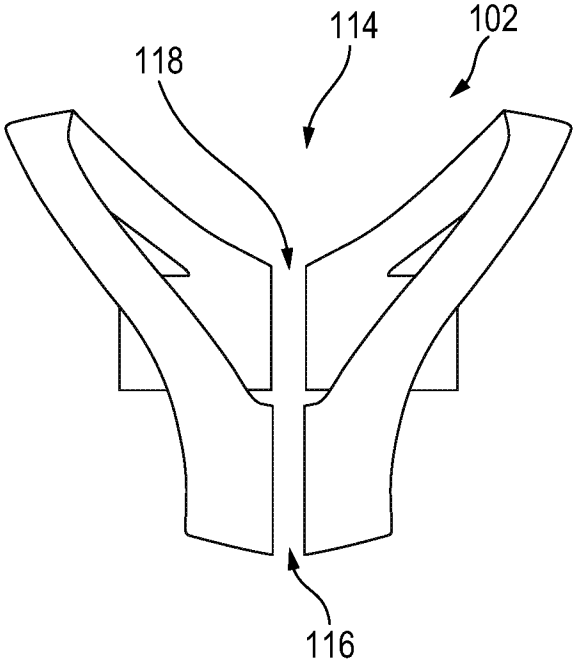
FIG. 13 is a front elevation view of a yoke, according to an embodiment of the present invention.
Figure 16:
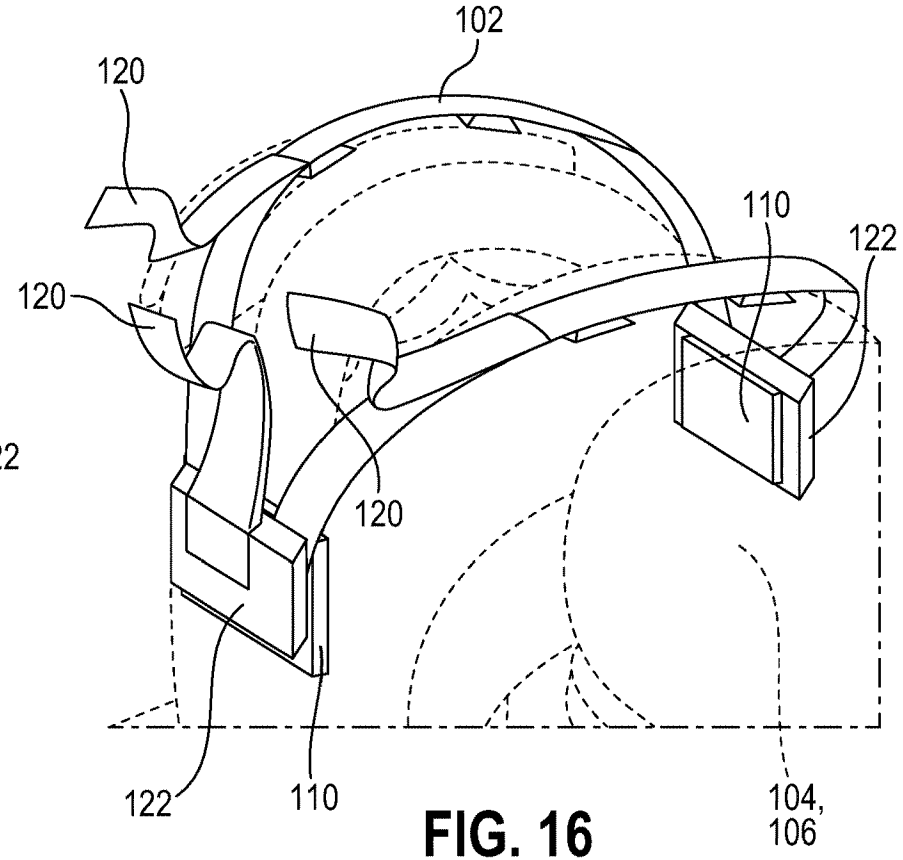
FIG. 16 is a front-side perspective view of yoke of an uncoupled anterior cranial shield, according to an embodiment of the present invention.
Figure 15:
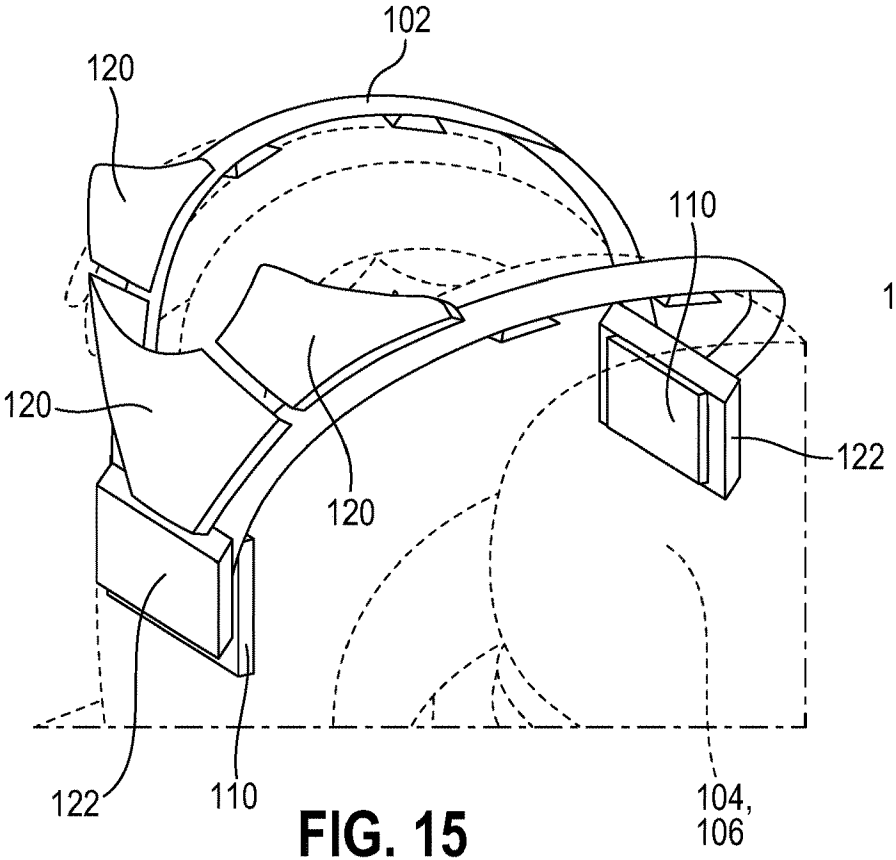
FIG. 15 is a front-side perspective view of yoke of an uncoupled anterior cranial shield, according to an embodiment of the present invention.

Referring to FIGS. 1-3, the yoke 102 may peripherally encloses a neck aperture 114 in which the wearer's neck resides when the uncoupled anterior cranial shield 100 is worn. Alternatively, referring to FIGS. 9-12, the yoke 102 may partially enclose the neck aperture 114 when the uncoupled anterior cranial shield 100 is worn, leaving an anterior opening 116 or a posterior opening 118. Referring to FIGS. 13-14, the yoke 102 may alternatively partially enclose the neck aperture 114 when the uncoupled anterior cranial shield 100 is worn, leaving an anterior and a posterior opening 118.

Referring to FIGS. 1-3, in one embodiment, the uncoupled anterior cranial shield 100 further includes at least one impact collar extension 120 extending from the yoke 102, wherein the suspended mask 108 attaches to the yoke 102 through at least one impact collar extension 120. At least one impact collar extension 120 may be composed of any suitable material, including, but not limited to, polycarbonates, carbon fiber reinforced polymers, carbon fiber alloys, titanium, aramids, poly-paraphenylene terephthalamide, or combinations thereof. Referring to FIGS. 1-3 and 15-16, the at least one impact collar extension 120 may have any suitable shape, including, but not limited to, extensions on each side from the yoke 102 or a U-shaped frontal configuration closed anteriorly in relationship to the neck. At least one impact collar extension 120 may be connected to the yoke 102 with fasteners as a distinct component or may be directly molded or welded as an inherent structural sub-component extension of the yoke 102. Adjustability may be achieved through variable connection locations within at least one impact collar extension 120 for the suspended mask 108 or by adding force dissipating spacers to fine-tune clearance area for appropriate helmet range of motion, or both.

At least one impact collar extension 120 further may comprise at least one force dissipater, including, but not limited to, force dissipating spacers, shock absorbing tracks, hinged spring shock absorbing connectors, torsional spring shock absorbing connectors, or combinations thereof. The impact collar extension 120 may facilitate the cantilever motion of the suspended mask 108. In various embodiments, the impact collar extension 120 may be formed in a shape that facilitates such motion, as shown in the embodiment depicted in FIGS. 15 and 16. Thus, in some embodiments, the impact collar extension 120 may comprise one or more other mechanical means such as mechanical living hinges, and hinges that allow one or both of rotational, torsional, and stretching-slidable movement between the yoke 102 and any one or more impact collar extension 120, all or any portion of which may be formed with a flexible elastomeric material.

In accordance with various embodiments, such as depicted in the drawings, one or both the yoke 102 and the impact collar extension 120 may itself include integral mechanical means to allow for flexible motion between the yoke 102 and the connection point 110 or the impact collar extension 120 and the connection point 110. In yet other embodiments, one or both the yoke 102 and the impact collar extension 120 may include a fixation point 122 that may include a discrete mechanical structure for dissipating force and or to achieve mechanical attachment between combinations of the yoke 102 and the connection point 110 and the impact collar extension 120, including, but not limited to, force dissipating spacers, shock absorbing tracks, hinged spring shock absorbing connectors, torsional spring shock absorbing connectors, and combinations thereof.

In accordance with the various embodiments, all or at least a portion of any one or more of the yoke 102 and the impact collar extension 120 used to affix the yoke 102 to the suspended mask 108 may be formed with materials selected from one or a combination of plastic and/or elastomeric materials, including, but not limited to, thermoplastic elastomers and thermoset elastomers. In some examples, the materials may specifically include rubber, for example, natural or synthetic polyisoprenes (thermosets) such as cis-1,4 polyisoprene. In some examples, the polymers may include auxetic materials, or smart polymers that are strain rate dependent, wherein some examples of smart polymers include poly (propyl acrylic acid), poly (ethacrylic acid), PMMA-PEG copolymer, Polysilamine, poly (4-vinylpyridine) (PVP), poly (2-vinylpyridine) (PVAm), poly (2-diethylaminoethyl methacrlate) (PDEAEMA).

The suspended mask 108 may be composed of any suitable material, including, but not limited to, carbon steels, stainless steels, titanium, polycarbonates, carbon fiber reinforced polymers, carbon fiber alloys, aramids, poly-paraphenylene terephthalamide, auxetic, rubber composites, composite materials, or combinations thereof. The suspended mask 108 may be coated with plastic vinyl or with any other suitable coating material for reducing friction.

Figure 19:
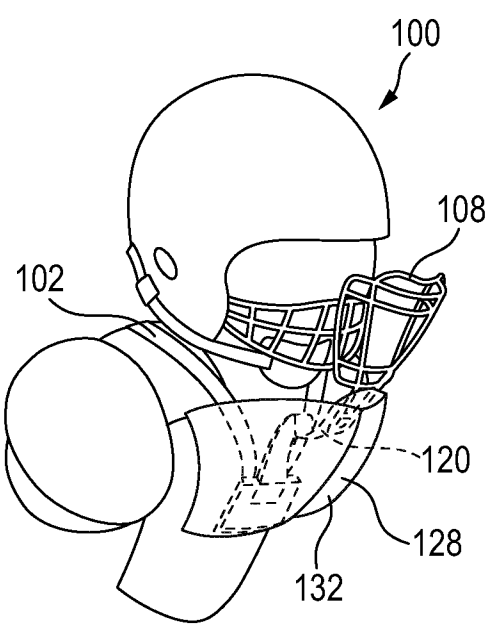
FIG. 19 is a front-side perspective view of an uncoupled anterior cranial shield, according to an embodiment of the present invention.
Figure 18:
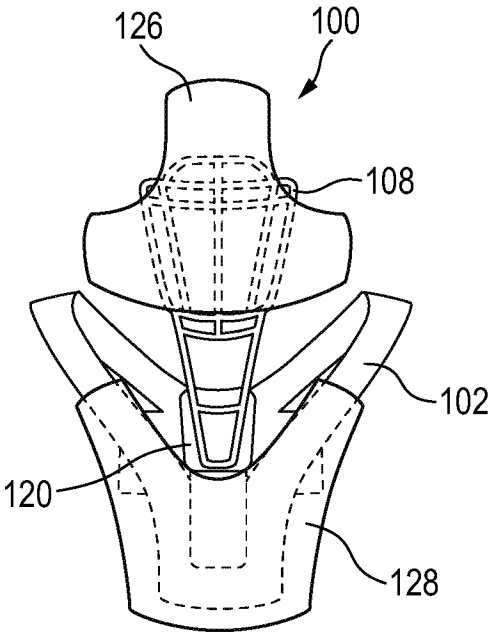
FIG. 18 is a front elevation view of an uncoupled anterior cranial shield, according to an embodiment of the present invention.
Figure 17:
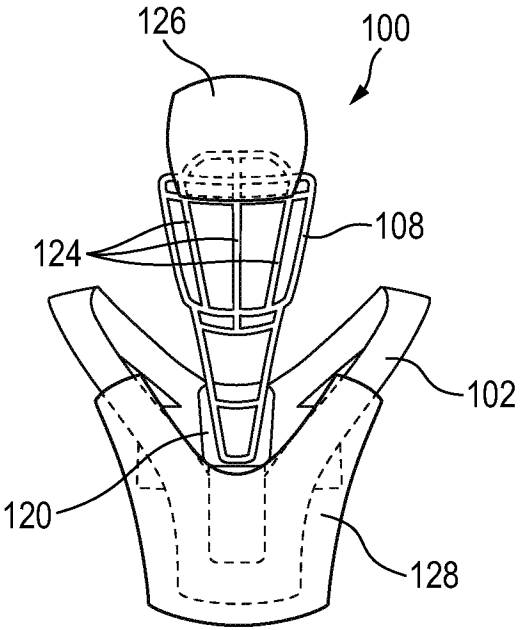
FIG. 17 is a front elevation view of an uncoupled anterior cranial shield, according to an embodiment of the present invention.
Figure 20:
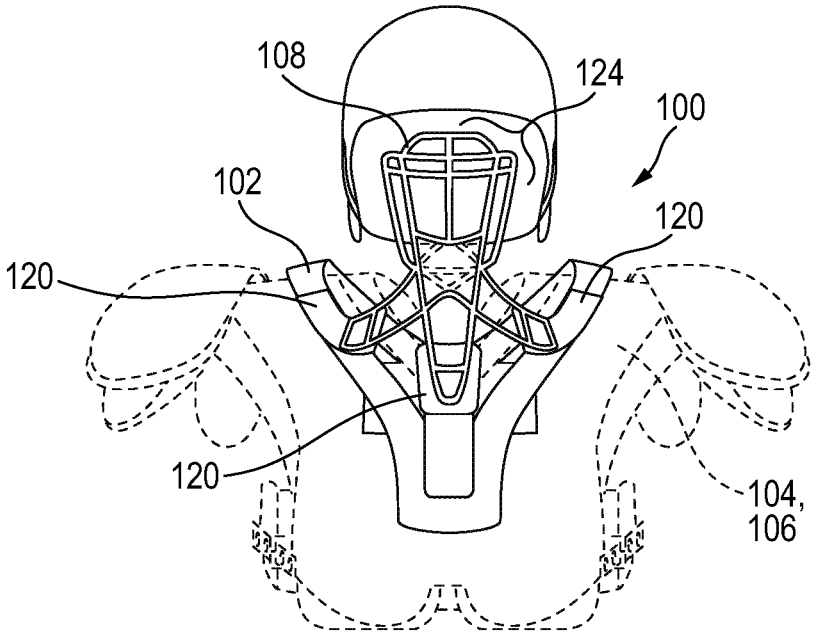
FIG. 20 is a front elevation view of an uncoupled anterior cranial shield, according to an embodiment of the present invention.
Figure 21:
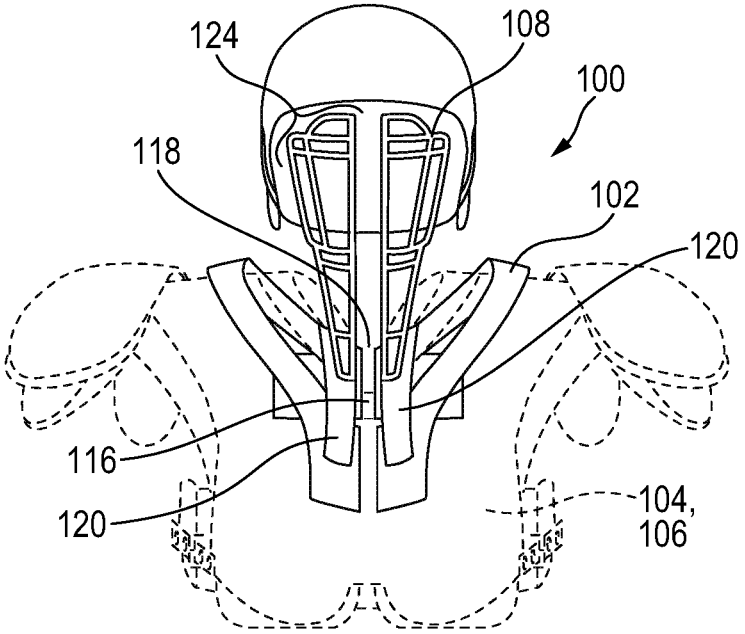
FIG. 21 is a front elevation view of an uncoupled anterior cranial shield, according to an embodiment of the present invention.
Figure 22:
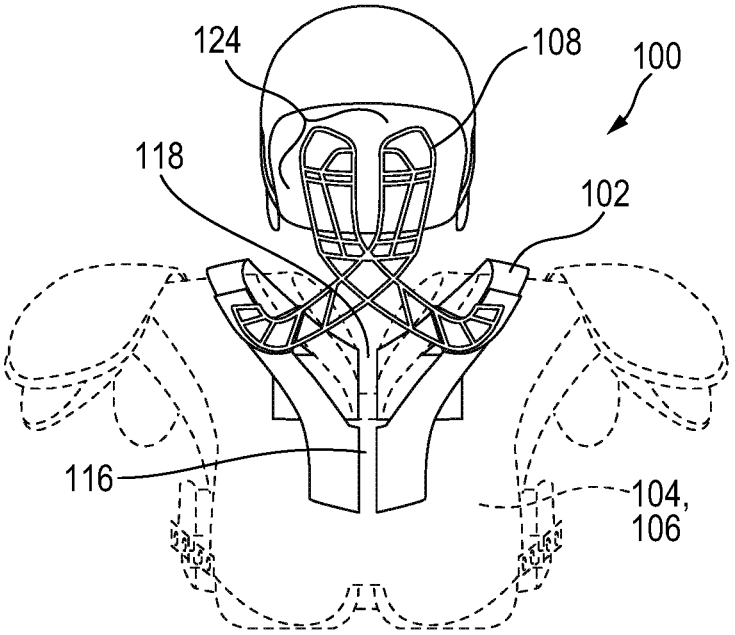
FIG. 22 is a front elevation view of an uncoupled anterior cranial shield, according to an embodiment of the present invention.

Referring to FIGS. 1-3, the suspended mask 108 may include a plurality of interconnected bars 124. Referring to FIGS. 17 and 18, the suspended mask 108 may include an auxiliary transparent visor extension 126. The auxiliary transparent visor extension 126 may be made from any suitable material, including, but not limited to, polycarbonates. The transparent visor extension 126 may be disposed in front of the plurality of interconnected bars 124, behind the plurality of interconnected bars 124, between the plurality of interconnected bars 124, or combinations thereof. The transparent visor extension 126 may extend above the plurality of interconnected bars 124 (FIG. 17), laterally from the plurality of interconnected bars 124, or both (FIG. 18). In one embodiment, the transparent visor extension 126 extends over the wearer's brow, over the wearer's forehead, over the wearer's temporal region, or combinations thereof. The transparent visor extension 126 may be coated with plastic vinyl or with any other suitable coating material for reducing friction. In addition, the transparent visor extension 126 may include a coating that provides UV or sun shading tinted protection or both. Referring to FIGS. 17-19, the yoke 102 (FIGS. 17 and 18), the impact collar extension 120, or both (FIG. 19) may include a guard 128. The guard 128 may be composed of any suitable material, including, but not limited to, polycarbonates, carbon fiber reinforced polymers, carbon fiber alloys, titanium, aramids, poly-paraphenylene terephthalamide, auxetic materials, rubber composites, or combinations thereof.

Figure 23:
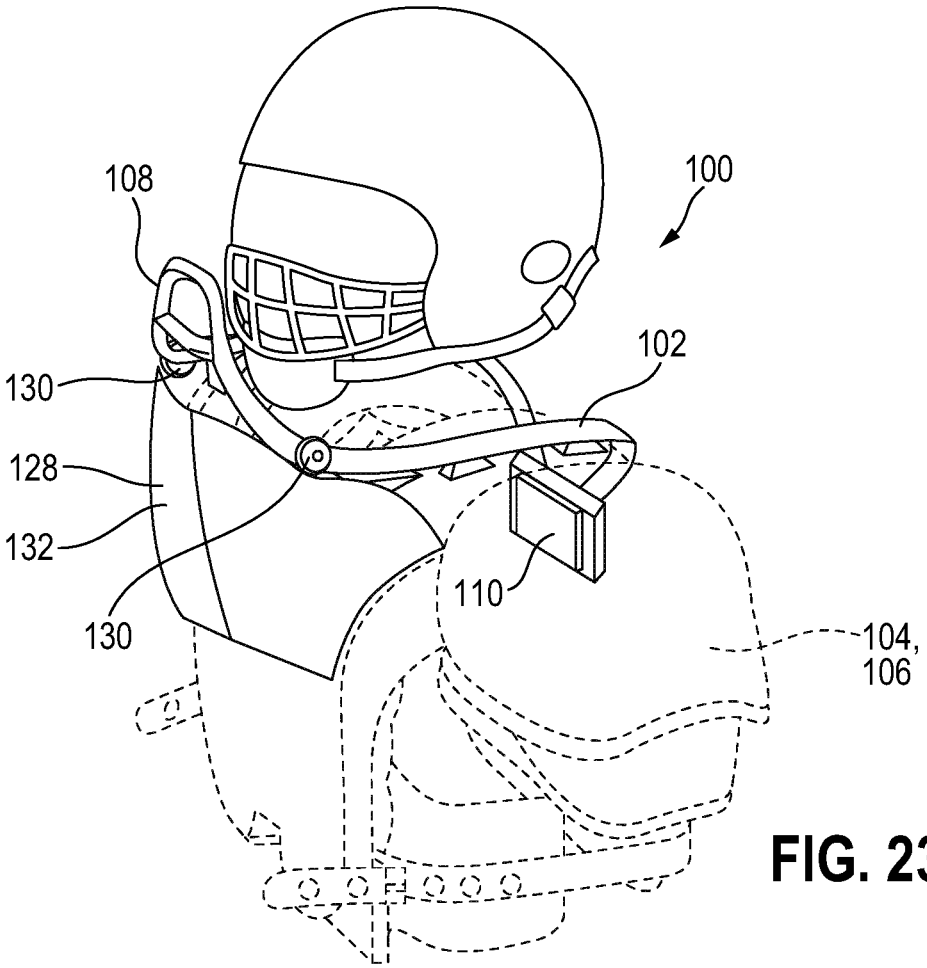
FIG. 23 is a front-side perspective view of an uncoupled anterior cranial shield, according to an embodiment of the present invention.
Figure 24:
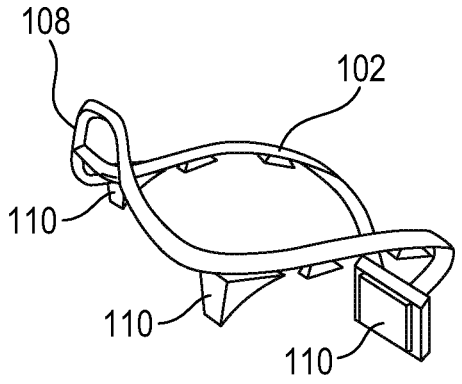
FIG. 24 is a front-side perspective view of a configuration of the yoke of FIG. 23 without hinges, according to an embodiment of the present invention.
Figure 25:
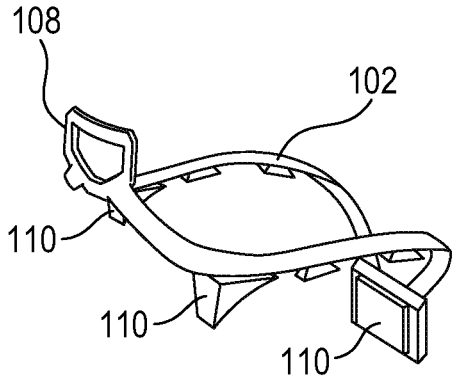
FIG. 25 is a front-side perspective view of an alternative configuration of the yoke of FIG. 23, according to an embodiment of the present invention.

Referring to FIGS. 19-23, the suspended mask 108 may have any suitable configuration, including, but not limited to, a single set of interconnected bars 124 affixed to a single impact collar extension 120 (FIG. 19), a single set of interconnected bars 124 affixed to a multiple impact collar extensions 120 (FIG. 20), two sets of adjacent interconnected bars 124 affixed to two distinct impact collar extensions 120 (FIG. 21), two sets of traversed interconnected bars 124 affixed to two distinct impact collar extensions 120 (FIG. 22), or a single set of interconnected bars 124 integral with the yoke 102 (FIG. 23). Referring to FIG. 23, the single set of interconnected bars 124 integral with the yoke 102 may include a mechanical joint such as, but not limited to, a hinge 130. Referring to FIGS. 24 and 25, two alternative configurations for the suspended mask 108 (without hinges 130) are shown. It will be appreciated that the features of any one of these suspended mask 108 embodiments may be combined with one another in any combination.

Referring to FIGS. 19 and 23, in some embodiments, the guard 128 may be and augmented chest guard 132. The augmented chest guard 132 may reduce or eliminate protrusion of a bar-type guard 128 emanating from the yoke 102 or the athletic shoulder pads 106. This augmented chest guard 132 may absorb more incoming frontal force that would a guard 128 covering only the impact collar extension 120. The arrangement of the augmented chest guard 132 shown may improve the ability of the wearer's chest to absorb incoming frontal force, thereby reducing the force intensity received by the wearer's head. The augmented chest guard 132 may be arranged to serve as the primary foundation of the suspended mask 108 rather than the yoke 102. The augmented chest guard 132 may be formed of the same or similar materials as the athletic shoulder pads 106, including, but not limited to being a plastic shell with underlying padding or composite materials suitable to receive a force, such as, but not limited to, a soft rubber compound like the material from which a putter grip is formed from. The augmented chest guard 132 may have enough strength to significantly reduce the frontal force but not accentuate or amplify any decelerative forces that occur upon a collision (such as, but not limited to, coup-contra coup whiplash forces). The augmented chest guard 132 may be used independently as an anterior cranial shield 100, may have an attached mask 108, and may be used in conjunction with a yoke 102 (FIG. 28 (*b*)).

Figure 26A:
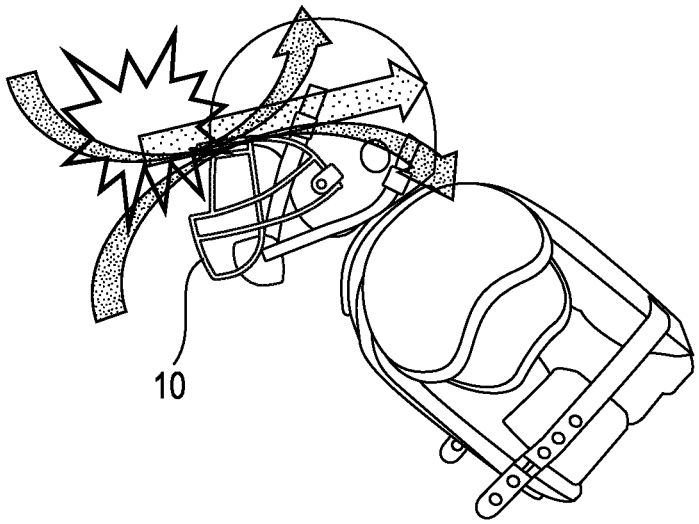
FIG. 26 (*a*) is a side elevation view of standard facemask showing the result of an application of force.
Figure 26B:
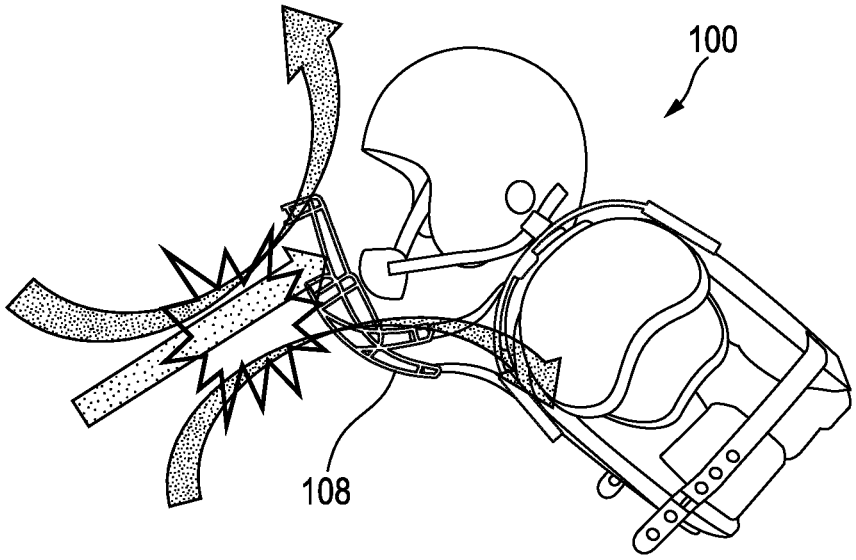

Referring to FIGS. 26 (*a*), 26 (*b*), 27 (*a*), and 27 (*b*), the uncoupled anterior cranial shield 100 used to protect facial structures reduces the need for metal or polymeric facemask frames directly attached to the helmet. By uncoupling the cage-like standard facemask 10 directly from the helmet, there will be a decreased risk of rapid deceleration to the head and brain. When the standard facemask 10 is a caged design that surrounds the mandibular region protruding beyond the helmet margin and attached to the helmet, there are increased frictional forces created with an opposing player or the ground, in which the standard facemask 10 can abruptly slow the head during a hit or fall or can place the head and neck complex into hyperextension, causing injury to the brain and spine. Rotational brain injury occurs when the head stops but the brain continues to rotate within the skull. Therefore, anchoring a suspended mask 108 to a support garment 104 such as athletic shoulder pads 106 provides greater contact area for mounting of the suspended mask 108. This increased area provides improved stability for anchoring the suspended mask 108 under excessive and/or repetitive impact loads as compared to a standard facemask 10 (FIG. 26 (*a*) compared to FIG. 26 (*b*)).

Referring to FIGS. 26 (*a*) and 26 (*b*), since it is mounted over a larger area with longer lever arms (the span from the shoulder to central line of body to contralateral shoulder is longer than the span from left and ride side of the skull to the central line), the uncoupled anterior cranial shield 100 (FIG. 26 (*b*)) provides better stability and resistance to impact, as well as torsional resistance as compared to a standard facemask 10 (FIG. 26 (*a*)). The larger contact area of mounting the suspended mask 108 to the chest region versus to the helmet will also provide better energy dissipation. Since stress is proportional to the applied force divided by the area of contact, mounting to the support garment 104 (athletic shoulder pads 106, in the context of American football) with greater contact area will result in less concentrated stress to the body and better energy dissipation due to the added stability of the suspended mask 108. Such an integration within the athletic shoulder pads 106 attenuates and diverts the focal forces directed to the head and brain to the much less vulnerable musculoskeletal structure of the chest, trapezius muscles/shoulders, and upper back. This force diversion, deflection, dissipation, and distribution likely decreases both the intensity and frequency of sub-concussive repetitive head impacts absorbed by the brain over time, while also better protecting the cervical spine by decreasing potential dynamic neck flexion conditions.

Figure 28A:
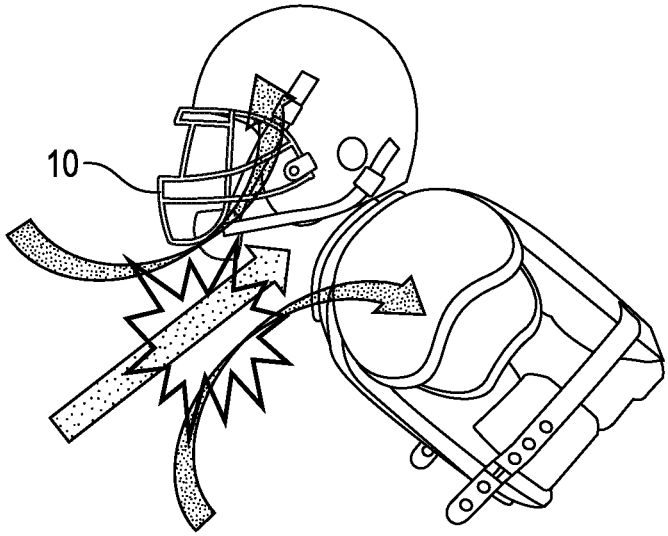
FIG. 28 (*a*) is a side elevation view of standard facemask showing the result of an application of force.
Figure 28B:
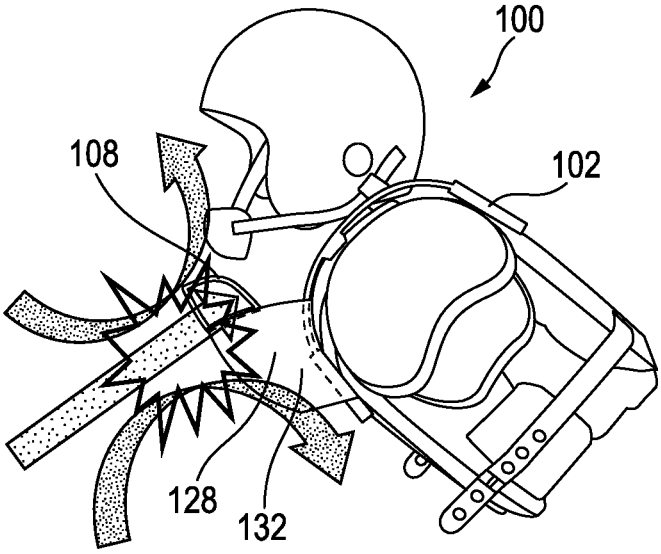

Referring to FIGS. 28 (*a*) and 28 (*b*), in one embodiment, wherein the augmented chest guard 132 is used independently as an anterior cranial shield 100, has an attached mask 108, and is used in conjunction with a yoke 102 (FIG. 28 (*b*)), direct impact linear force and intensity of rotational and angular mechanical forces absorbed by the wearer's brain and spine may be reduced in comparison to a standard facemask 10 (FIG. 28 (*a*)). Primary direct impact force may be dissipated, diverted, and distributed to a wearer's upper back and chest musculoskeletal structures.

A primary advantage of helmet and standard facemask 10 dissociation is diversion/deflection of the initial force directed at the head and neck to much less vulnerable and robust musculoskeletal structures, by way of its connections to the athletic shoulder pads 106. Within this uncoupled anterior cranial shield 100 system, the head is no longer the primary reception point for all forces directed above the shoulders during play. Again, in the context of American football, offensive and defensive linemen may experience low-velocity sub-concussive head impacts on the majority of football plays. Other positional players, such as quarterback and wide receiver, sustain much less. As stated previously, in the backdrop of emerging research that establishes long-term accumulation of sub-concussive repetitive head impacts as a risk factor for delayed adverse neurologic and/or psychiatric consequences in susceptible individuals, the development and cultivation of a more comprehensive head and brain protective system to mitigate and reduce sub-concussive repetitive head impacts is imperative for long-term player safety and football sustainability/viability. Such a goal can be achieved by either fundamentally altering the established physical nature of football through radical rules changes (or simply eliminating the game), or fundamentally improving the protective equipment primarily responsible for protecting the head. This uncoupled anterior cranial shield 100 system aims to achieve the latter and minimize the former by altering the paradigm of energy dissipating systems focused solely on the head protection for football and other sports.

Figure 27A:
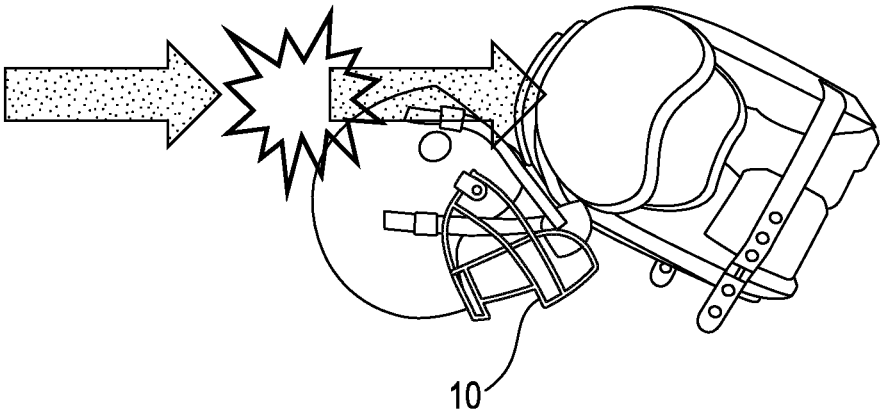
FIG. 27 (*a*) is a side elevation view of standard facemask showing the result of an application of force.
Figure 27B:
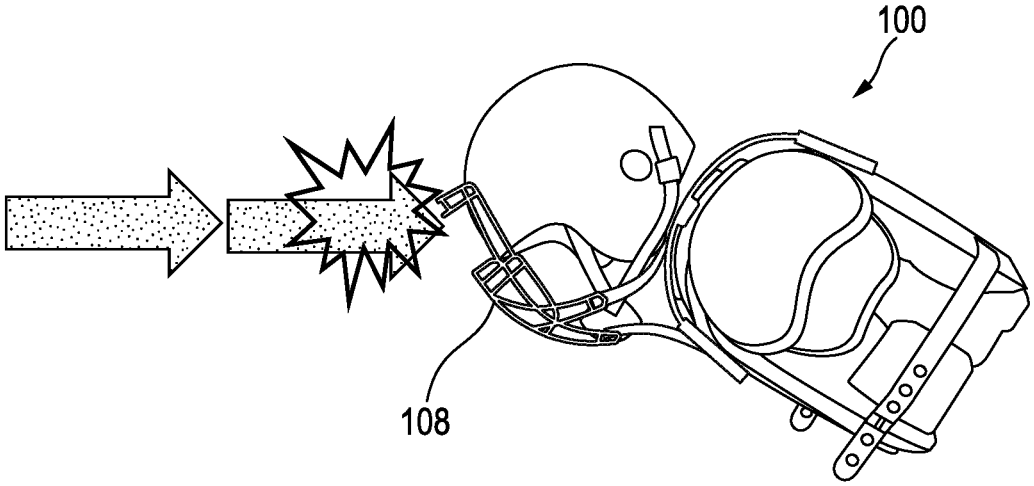

Catastrophic spinal cord injury, although exceedingly rare, may occur while playing football, especially within the inexperienced player group. This injury classically occurs when a direct mechanical force is applied to the head when the neck is flexed (neck flexion condition), resulting in a traumatic cervical spine and/or spinal cord injury. Novice football players are constantly reminded by coaches to "keep your head up" primarily in order to protect against a cervical spine injury. Referring to FIGS. 27 (*a*) and 27 (*b*), integrating face and head protection within athletic shoulder pads 106 may virtually eliminate the conditions necessary for sustaining such a spinal cord injury by preventing neck hyperflexion or hyperextension from even occurring, and ensuring a "heads up" position upon contact (FIG. 27 (*b*) as compared to a standard facemask 10 in FIG. 27 (*a*)).

Emerging research may also demonstrate long-term delayed deleterious effects to the cervical and thoracic spine from repetitive head impacts, initiating the degenerative cascade of the spine at an earlier stage and in an earlier population group. Additionally, supplemental uncoupled head protection may provide improved protection from brachial plexus traction injuries (so-called "stingers"), which occur in conditions of extreme positions of neck lateral flexion. The neck is biomechanically weak in lateral bending due the anatomical orientation of the coronal cervical facet joints, thereby making youth football players more susceptible to injury in a laterally induced mode.

It will be appreciated that while the description and drawings herein depict components of the uncoupled anterior cranial shield 100 used in the context of American football gear, the invention is not in any manner limited to use for any particular activity or sport. Thus, in various embodiments, the uncoupled anterior cranial shield 100 may be employed for use in other activities such as motor sports, other ball sports, equestrian activities, and more generally activities in which protection of a wearer's head from impact is desirable. Further, while the drawings and description do not make specific reference to other protective gear, the invention contemplates the use of gear such as low profile head gear and low profile helmets to protect the wearer's head from materials and objects that are not deflected by the uncoupled anterior cranial shield 100. Referring again to the drawings, FIGS. 20-23, 26 (*a*), 26 (*b*), 27 (*a*), and 27 (*b*) depict the use of what would be considered conventional football helmets together with the uncoupled anterior cranial shield 100. Of course, these depictions are in no manner limiting and other head and face protective gear may be used to supplement the uncoupled anterior cranial shield 100.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof. Unless expressly excluded herein all such combinations and sub-combinations are intended to be within the scope of the general inventive concepts. Still further, while various alternative embodiments as to the various aspects, concepts and features of the inventions (such as alternative materials, structures, configurations, methods, devices and components, alternatives as to form, fit and function, and so on) may be described herein, such descriptions are not intended to be a complete or exhaustive list of available alternative embodiments, whether presently known or later developed.

Those skilled in the art may readily adopt one or more of the inventive aspects, concepts and features into additional embodiments and uses within the scope of the general inventive concepts, even if such embodiments are not expressly disclosed herein. Additionally, even though some features, concepts and aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated.

Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. An uncoupled anterior cranial shield, comprising: a yoke configured to attach to a support garment or integrated with the support garment, wherein the yoke is configured to partially cover shoulders of a wearer; and a suspended mask including at least one impact collar extension attached at a first end to the yoke, the suspended mask extending upward from the yoke to a free suspended end and comprising at least one interconnected bar attached at one end of the at least one impact collar extension, the suspended mask configured to at least partially shield a face of the wearer of the uncoupled anterior cranial, wherein the suspended mask is configured to be suspended in front of the wearer's face and worn free of any contact with the face of the wearer and without attachment to a helmet that is separately donned by the wearer, and wherein the suspended mask is free of force communicating persistent connection to a head of the wearer other than indirectly through the support garment to redirect impact force from a player collision away from the wearer's head and neck and into the wearer's torso.

2. The uncoupled anterior cranial shield of claim 1, wherein the yoke is composed of a material selected from the group consisting of polycarbonates, carbon fiber reinforced polymers, carbon fiber alloys, titanium, aramids, poly-paraphenylene terephthalamide, and combinations thereof and wherein the suspended mask is composed of a material selected from the group consisting of carbon steels, stainless steels, polycarbonates, carbon fiber reinforced polymers, carbon fiber alloys, titanium, aramids, poly-paraphenylene terephthalamide, composite materials, and combinations thereof.

3. The uncoupled anterior cranial shield of claim 1, wherein the yoke is configured to attach to or be integrated with a main body arch of the support garment.

4. The uncoupled anterior cranial shield of claim 3, wherein the yoke is configured to be integrated with or attached to the main body arch at two of a chest portion of the support garment, a shoulder portion of the support garment, and an upper back portion of the support garment.

5. The uncoupled anterior cranial shield of claim 3, wherein the yoke is configured to be integrated with or attached to the main body arch at each of a chest portion of the support garment, a shoulder portion of the shoulder pads, and an upper back portion of the support garment.

6. The uncoupled anterior cranial shield of claim 1, wherein the support garment comprises athletic shoulder pads and wherein the yoke peripherally encloses a neck aperture defined by the athletic shoulder pads in which the wearer's neck resides when the uncoupled anterior cranial shield is worn.

7. The uncoupled anterior cranial shield of claim 1, wherein the yoke partially encloses a neck aperture in which the wearer's neck resides when the uncoupled anterior cranial shield is worn, leaving an anterior opening, a posterior opening, or a combination thereof.

8. The uncoupled anterior cranial shield of claim 1, wherein the at least one impact collar extension is composed of a material selected from the group consisting of polycarbonates, carbon fiber reinforced polymers, carbon fiber alloys, titanium, aramids, poly-paraphenylene terephthalamide, and combinations thereof.

9. The uncoupled anterior cranial shield of claim 1, wherein the at least one impact collar extension further includes at least one force dissipater comprising a hinge or a living hinge.

10. The uncoupled anterior cranial shield of claim 1, wherein the suspended mask is coated with plastic vinyl.

11. The uncoupled anterior cranial shield of claim 1, wherein the suspended mask includes a plurality of interconnected bars.

12. The uncoupled anterior cranial shield of claim 1, wherein the suspended mask includes a transparent visor extension.

13. The uncoupled anterior cranial shield of claim 1, wherein the suspended mask extends over the wearer's brow, extends over the wearer's forehead, or extends over the wearer's temples.

14. The uncoupled anterior cranial shield of claim 1, comprising an augmented chest guard connectable to the yoke and configured to be positioned below the suspended mask.

15. An uncoupled anterior cranial shield, comprising:

a support garment;

a yoke configured to attach to the support garment, wherein the yoke is configured to partially cover shoulders of a wearer; and a suspended mask including at least one impact collar extension attached to the yoke, the suspended mask extending from the yoke and including a plurality of interconnected bars attached at one end of the at least one impact collar extension, wherein the suspended mask is configured to at least partially shield a face of the wearer of the uncoupled anterior cranial when the yoke and suspended mask are affixed thereto, wherein the suspended mask is configured to be suspended in front of the wearer's face and worn free of any contact with the face of the wearer and without attachment to a helmet that is separately donned by the wearer, and wherein the suspended mask is free of force communicating persistent connection to a head of the wearer other than indirectly through the support garment to redirect impact force from a player collision away from the wearer's head and neck and into the wearer's torso.

16. The uncoupled anterior cranial shield of claim 15, wherein the plurality of interconnected bars are integral with the yoke.

17. The uncoupled anterior cranial shield of claim 16, wherein the plurality of interconnected bars is integral with the yoke via a hinge connection.

18. The uncoupled anterior cranial shield of claim 15, comprising an augmented chest guard connectable to the yoke and configured to be positioned below the suspended mask.

19. The uncoupled anterior cranial shield of claim 15, wherein the support garment comprises athletic shoulder pads.

20. The uncoupled anterior cranial shield of claim 1, wherein further comprising a mechanical attachment structure between the yoke and the at least one impact collar extension for dissipating force.

21. The uncoupled anterior cranial shield of claim 1, wherein the at least one impact collar extension is adjustable with respect to the yoke.

22. The uncoupled anterior cranial shield of claim 1, wherein the yoke includes a curved portion to dissipate force.

* * * * *